United States Patent [19]

Potier et al.

[11] 4,040,469

[45] Aug. 9, 1977

[54] CASTING OF MOLTEN METALS

[75] Inventors: Pierre Roger Potier, La Celle Saint Cloud, France; Tadamichi Sota, Kurashiki, Japan

[73] Assignee: Foseco International Limited, Birmingham, England

[21] Appl. No.: 695,553

[22] Filed: June 14, 1976

[30] Foreign Application Priority Data

July 10, 1975 United Kingdom ..... 29158/75

[51] Int. Cl.[2] ..... B22D 27/00

[52] U.S. Cl. ..... 164/56; 164/123; 164/133

[58] Field of Search ..... 164/55, 56, 72, 121, 164/123, 133

[56] References Cited

U.S. PATENT DOCUMENTS

| | | | |
|---|---|---|---|
| 3,612,155 | 10/1971 | Matsuyama | 164/123 X |
| 3,810,506 | 5/1974 | Kobayashi | 164/133 |
| 3,848,655 | 11/1974 | Sato et al. | 164/123 |
| 3,934,637 | 1/1976 | Potier | 164/123 X |

FOREIGN PATENT DOCUMENTS

| | | | |
|---|---|---|---|
| 1,051,160 | 1/1954 | France | 164/133 |
| 2,124,355 | 11/1972 | Germany | 164/123 |
| 2,125,792 | 11/1972 | Germany | 164/123 |
| 2,432,950 | 1/1975 | Germany | 164/123 |

*Primary Examiner*—Ronald J. Shore
*Attorney, Agent, or Firm*—Cushman, Darby & Cushman

[57] ABSTRACT

A process for casting an ingot from a molten metal by bottom pouring molten metal into an ingot mould is described in which there is located in the ingot mould a bonded flux composition comprising one or more fluxing agents, together with a bonded refractory composition comprising particulate refractory material and fibrous material, the bonded refractory composition being positioned in relation to the bonded flux composition to protect the latter from the initial upsurge of molten metal when pouring commences. The bonded flux composition and the bonded refractory composition can be formed together as a laminate, or the bonded flux composition can be formed with an insert of the bonded refractory composition. Alternatively, the bonded flux composition can be placed on the base of the ingot mould while the bonded refractory composition is placed as a striker pad in a recessed basin in the bottom plate of the mould.

6 Claims, 2 Drawing Figures

CASTING OF MOLTEN METALS

The present invention relates to the casting of molten metals to form ingots. While the method to be described may be used to advantage in the casting of various metals, its principal use is in the casting of steel ingots, and the following description is accordingly primarily directed to that use.

Ingot moulds may be charged with molten metal either by teeming the metal into the top of the ingot mould or by filling the ingot mould with molten metal from the base. The present invention is directed to this latter case, so-called bottom-pouring.

When molten steel is bottom-poured into an ingot mould there is a tendency for the surface of the molten metal to oxidise in contact with air and to form an oxide skin thereon. In addition during solidification, the ingot tends to weld itself to the mould walls, and subsequent stripping from the mould, if not rendered impossible, may result in damage to the mould walls and/or defects in the ingot surface.

In British Pat. specification No. 1431787 there is described a procedure comprising locating in the ingot mould prior to the commencement of pouring, a bonded composition comprising one or more fluxing agents and expandable graphite.

During casting, the bonded composition is borne up on the rising metal surface; because of the heat of the molten metal, the composition disintegrates under the expansion of the graphite and thereafter fuses to form a fluxing cover on the surface of the molten metal. This leads to an improvement of the surface finish of the cast ingot, less surface oxidation and a decrease in the level of surface inclusions. Furthermore, the presence of the composition on the rising metal surface protects that surface, which is turbulent because of the up-flowing molten metal, from contact with the atmosphere.

The expanded composition also forms a layer of high heat-insulating characteristics on the molten metal surface, thus reducing heat loss during pouring.

Due to the effect of the initial surge of molten metal entering the mould, rapid erosion of the bonded composition can occur. As a result, molten metal becomes exposed to the atmosphere and at the beginning of ingot casting, the fluxing cover is incomplete.

We have now found that in processes such as that described in specification No. 1431787 the bottom pouring procedure can be further improved by providing means for protecting the bonded composition during the first stages of bottom pouring when there is an initial upsurge of molten metal at the base of the mould.

Accordingly, the present invention provides a process for casting an ingot from a molten metal by bottom pouring molten metal into an ingot mould wherein there is located in the ingot mould a bonded flux composition, comprising one or more fluxing agents, together with a bonded refractory composition comprising particulate refractory material and fibrous material, the bonded refractory composition being positioned in relation to the bonded flux composition to protect the latter from the initial upsurge of molten metal when pouring commences.

Suitable fluxing agents include iron oxide ($Fe_2O_3$ or $Fe_3O_4$), sodium carbonate (soda ash), potassium carbonate, alkali metal and alkaline earth metal fluorides, alkali metal oxides or substances which yield alkali metal oxides on heating, natural or synthetic silicates such as basalt and wollastonite, natural or synthetic borates such as calcium borate or colemanite, and fly ash. Mixtures of such fluxing agents may be used.

Suitable bonded flux compositions are described in British pat. specifications Nos. 1431787 and 1,298,831. The bonded flux composition may be a single or multilayer material as appropriate to the particular production technique employed.

Both the bonded flux composition and the bonded refractory composition can include any binder or composition of binders suitable for the purpose. Examples of suitable binders are organic binders such as natural or synthetic resins, gums, starches and cellulose derivatives, of which urea-formaldehyde and phenol formaldehyde resins are preferred. Inorganic binders such as alkali metal silicates, colloidal oxide sols and clays may also be used, of which sodium silicate (waterglass), colloidal silica sol and bentonite or ball clay are preferred. If desired a combination of organic and inorganic binders may be used.

Typically the bonded flux composition will comprise 5 to 30% by weight of binder, the balance being fluxing agent and any other optional ingredients.

The bonded refractory composition also contains fibrous material which may comprise inorganic or organic fibres, or mixtures thereof. Examples of suitable fibres are asbestos, slag wool, glass wool, rock wool, aluminosilicate fibre and paper pulp.

In addition, the bonded refractory composition contains particulate refractory material of which silica, calcium silicate, grog, olivine, alumina, magnesia, e.g., magnesite, chamotte, vermiculite and perlite are examples of suitable materials.

Typically, the bonded refractory composition may have the following ingredients in the following proportions by weight:

| | |
|---|---|
| particulate refractory material | 50% to 97% |
| fibrous material | 1% to 20% |
| binder | 2% to 30% |

The bonded refractory composition may be made by blending dry ingredients, for example in a cone blender, adding to the dry ingredients a solution of the binder, usually in water, forming the composition into the desired shape by ramming or pressing in a suitable mould, and curing the shaped composition after removal from the mould.

The bonded refractory composition may also be prepared by forming a slurry of the ingredients in a carrier liquid such as water, locating the slurry in a vessel having a mesh wall, removing liquid from the slurry through the mesh wall so as to deposit a mat of the solid constituents of the slurry on the mesh wall, separating the mat so formed from the mesh wall and drying the mat. The removal of the carrier liquid may be achieved by the application of pressure or vacuum as desired.

The bonded refractory composition may be used in the process of the invention together with the bonded flux composition either in physical combination therewith or separate therefrom, provided the bonded refractory composition is positioned in the mould to protect the bonded flux composition.

Thus, the two compositions may be formed together as a laminate, or the bonded flux composition may be formed with an insert of the bonded refractory composition.

Alternatively, the bonded refractory composition may be located on the bottom plate of the ingot mould or in a recessed basin in the bottom plate and positioned so as to absorb the impact of molten metal flowing into the mould through the bottom plate.

The bonded refractory composition may be fabricated so that in use it protects the whole of the bonded refractory composition or only a part thereof. Thus, the bonded refractory composition may be dimensioned to provide a complete cover over the metal as it flows into and rises up the mould or it may be dimensioned to provide a central insert within the bonded flux composition.

Two embodiments of the invention are shown, by way of example, in the accompanying diagrammatic drawings, in which.

Figure 1:
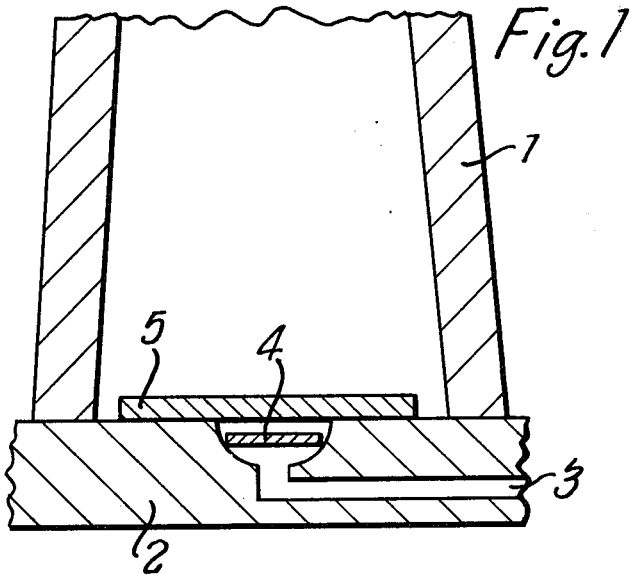
FIG. 1 is a section through an ingot mould for bottom pouring set up for carrying out the process of the invention.
Figure 2:
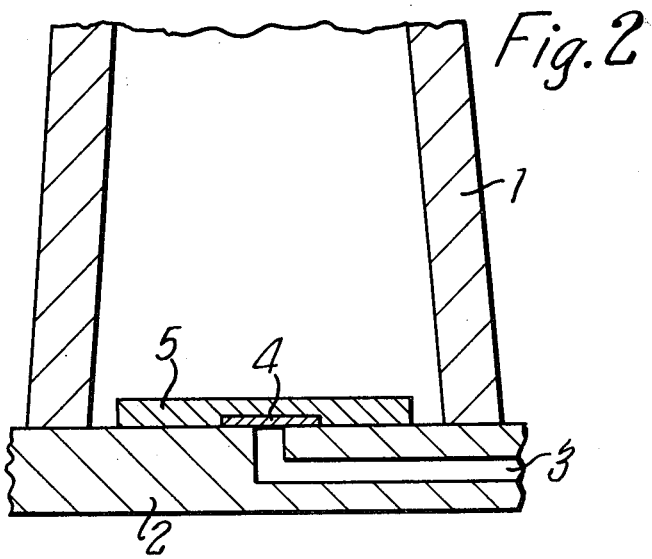
FIG. 2 is a section similar to FIG. 1 but of an alternative embodiment.

In both figures, an ingot mould body designated 1 is seated on a base plate 2 incorporating a conventional runner 3. In accordance with the present invention there is located in the base of the mould prior to bottom pouring a pad 4 of bonded refractory composition and a pad of bonded flux composition 5. In the arrangement of FIG. 1, the two pads are separate, while in the arrangement in FIG. 2, the pad 4 is formed as an insert in pad 5.

Also in carrying out the process of the invention anti-piping materials may be provided, typically as a bonded composition, positioned in the mould so as to provide an anti-piping layer above the flux layer afforded by fusion of the bonded flux composition.

Any bonded anti-piping composition employed may be used in physical combination with either or both of the bonded flux composition and the bonded refractory composition or separate therefrom, provided the required relationship between these various compositions is achieved during bottom pouring.

The anti-piping materials employed may be any of those well known in the art and typical compositions may comprise an easily oxidisable metal such as aluminum or calcium, a refractory material, fibrous material, a binder, and optionally an oxidising agent. In addition, such compositions may include a material which expands on heating such as vermiculite, perlite or, preferably, expandable graphite.

The following example will serve further to illustrate the invention:

EXAMPLE

A bonded refractory composition in the form of a square pad and having the following composition by weight:

| | |
|---|---|
| silica sand | 85% |
| paper | 4% |
| asbestos | 5% |
| wheat flour | 4% |
| urea-formaldehyde resin | 2% |

was prepared using the following procedure.

The components were mixed with about 4 times their volume of water to produce a uniform slurry, which was then dewatered by vacuum onto a wire mesh former so as to produce a pad 350 cm² in cross-sectional area and 1.2 cm thick. The pad was then dried at about 150° C for about 2 hours.

The pad was then placed centrally in a mould of cross-sectional area 500 cm².

A bonded flux composition was prepared in the form of a square pad as follows:

A dry mixture having the following composition by weight was prepared in a cone blender:

| | |
|---|---|
| fly ash | 63% |
| sodium carbonate | 2% |
| calcium fluoride | 5% |
| iron oxide | 5% |
| expandable graphite | 6% |
| crushed coke | 19% |

An aqueous solution containing 20% by weight of sodium metasilicate and 20% by weight of starch was aded to the dry ingredients. The "green" composition so formed was then pressed around the bonded refractory pad in the 500 cm² mould to form a composite pad 5.0 cm thick of the type shown in FIG. 2. After removal from the mould the composite pad incorporating the bonded refractory pad as an insert therein was dried for about 4 hours at 150° C.

The composite pad was placed at the bottom of an ingot mould with the insert facing the base of the mould and molten steel at 1650° C was bottom poured into the mould.

After the steel had solidified the ingot was stripped from the mould and examined. The ingot showed little evidence of inclusions and surface oxidation and the surface finish was good.

We claim:

1. In a process for casting an ingot from a molten metal by bottom pouring molten metal into an ingot mould through a molten metal inlet located adjacent the bottom of said mould and wherein there is located in the ingot mould a bonded flux composition consisting essentially of at least one fluxing agent, the improvement which comprises locating in the ingot mould adjacent said inlet a bonded refractory composition consisting essentially of particulate refractory material and fibrous material, the bonded refractory composition being positioned in relation to the bonded flux composition so that molten metal first entering said mould contacts said bonded refractory composition before contacting said bonded flux composition thereby protecting the latter from the initial upsurge of molten metal when pouring commences.

2. The process of claim 1 wherein the flux composition comprises at least one material selected from the class consisting of iron oxide, alkali metal carbonates, alkali metal fluorides, alkali metal oxides, alkaline earth metal fluorides, silicates, borates and fly ash.

3. The process of claim 1 wherein the bonded refractory composition consists essentially of (by weight):

| | |
|---|---|
| particulate refractory material | 50 to 97% |
| fibrous material | 1 to 20% |
| binder | 2 to 30%. |

4. The process of claim 1 wherein the bonded flux composition and the bonded refractory composition are formed together as a laminate.

5. The process of claim 1 wherein the bonded flux composition is formed with an insert of the bonded refractory composition.

6. In a process for casting an ingot from a molten metal by bottom pouring molten metal into an ingot mould, wherein there is located in the ingot mould a bonded flux composition consisting essentially of at least one fluxing agent, the improvement which comprises locating in the ingot mould a bonded refractory material and fibrous material, the bonded refractory composition being positioned in relation to the bonded flux composition to protect the latter from the initial upsurge of molten metal when pouring commences, the bonded flux composition being placed on the base of the ingot mould and the bonded refractory composition being placed as a striker pad in a recessed basin in the bottom plate of the mould.

* * * * *